US011988403B2

(12) United States Patent
Jin et al.

(10) Patent No.: US 11,988,403 B2
(45) Date of Patent: May 21, 2024

(54) AIR CONDITIONER AND CONTROL METHOD THEREOF

(71) Applicant: LG ELECTRONICS INC., Seoul (KR)

(72) Inventors: Hongsuk Jin, Seoul (KR); Sanghun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 665 days.

(21) Appl. No.: 17/162,305

(22) Filed: Jan. 29, 2021

(65) Prior Publication Data

US 2021/0239350 A1 Aug. 5, 2021

(30) Foreign Application Priority Data

Jan. 31, 2020 (KR) ..... 10-2020-0011698

(51) Int. Cl.

| | |
|---|---|
| ***F24F 11/74*** | (2018.01) |
| ***F24F 1/10*** | (2011.01) |
| ***F24F 1/16*** | (2011.01) |
| ***F24F 1/32*** | (2011.01) |
| ***F24F 1/48*** | (2011.01) |
| ***F24F 11/00*** | (2018.01) |

(Continued)

(52) U.S. Cl.

CPC ..... *F24F 11/74* (2018.01); *F24F 1/10* (2013.01); *F24F 1/16* (2013.01); *F24F 1/32* (2013.01); *F24F 1/48* (2013.01); *F24F 11/0001* (2013.01); *F24F 13/10* (2013.01); *F24F 13/30* (2013.01); *F24F 2110/12* (2018.01); *F24F 2140/12* (2018.01)

(58) Field of Classification Search

CPC .. F24F 1/32; F24F 13/30; F24F 12/001; F24F 1/48; F24F 2110/12; F24F 11/74; F24F 13/10

See application file for complete search history.

(56) References Cited

U.S. PATENT DOCUMENTS

2017/0003036 A1* 1/2017 Andersson ..... F24F 12/001

FOREIGN PATENT DOCUMENTS

JP 2006-308241 A 11/2006
JP 2019-148342 A 9/2019

(Continued)

OTHER PUBLICATIONS

PCT Search Report dated May 26, 2021 on PCT International Patent Application No. PCT/KR2021/001250.

*Primary Examiner* — Lionel Nouketcha

(74) *Attorney, Agent, or Firm* — Birch, Stewart, Kolasch & Birch, LLP

(57) ABSTRACT

An air conditioner includes an outdoor unit having a compressor for compressing a refrigerant and an outdoor heat exchanger. A ventilator is connected to the outdoor unit by a plurality of refrigerant pipes. The ventilator includes a case having a supply passage, through which the outside air flows into the indoor space, a discharge passage through which the indoor air is discharged to the outside, a partition wall disposed in the case and separating the supply passage and the discharge passage, a main heat exchanger disposed in the supply passage, an outside air inlet damper, an indoor air outlet damper, a circulation hole damper, an outdoor temperature sensor, and a controller, configured to control operations of the dampers.

17 Claims, 12 Drawing Sheets

(51) Int. Cl.

| | |
|---|---|
| ***F24F 13/10*** | (2006.01) |
| ***F24F 13/30*** | (2006.01) |
| *F24F 110/12* | (2018.01) |
| *F24F 140/12* | (2018.01) |

(56) References Cited

FOREIGN PATENT DOCUMENTS

| | | | | |
|---|---|---|---|---|
| KR | 10-2008-0012503 | | | 2/2008 |
| KR | 10-2009-0048244 | | | 5/2009 |
| KR | 20130083553 | A | * | 7/2013 |
| WO | WO 2008/111788 | A1 | | 9/2008 |

* cited by examiner

AIR CONDITIONER AND CONTROL METHOD THEREOF

BACKGROUND

1. Technical Field

The present disclosure relates to an air conditioner and a control method thereof, and more particularly to an air conditioner having a ventilator for heat exchanging air with a refrigerant.

2. Description of the Related Art

An indoor unit for controlling the temperature of an indoor space by circulating indoor air has a problem in that the indoor unit merely circulates stagnant air, such that fresh air may not be provided continuously for a user.

Accordingly, a ventilator may be used to continuously supply fresh outside air to the indoor space by introducing outside air and discharging indoor air.

The ventilator may control the temperature of air, supplied to the indoor space, by heat exchanging between indoor air, discharged to the outside, and outside air supplied to the indoor space, or may heat the air introduced into the indoor space by further including a heater.

Korean Patent Application No. 1020150122092 discloses a ventilation system based on dedicated outdoor air system (DOAS), in which by heat exchange between outdoor air and indoor air, air introduced from the outside is supplied to an indoor space; and a liquid desiccant is used to dehumidify the outside air flowing into the indoor space. In this system, there is a problem in that the outside air supplied to the indoor space may not be provided at a temperature desired by a user, such that it is difficult to properly control the temperature of the indoor space.

Further, Korean Patent Application No. 10-2010-0039582 discloses a method of supplying outside air to an indoor space by passing the outside air through a separate cooling coil. However, the method has a problem in that when the temperature of flowing air is controlled by using the cooling coil which consumes power separately, a large amount of power consumption is required, thereby reducing energy efficiency.

SUMMARY

It is an object of the present disclosure to provide an air conditioner having a ventilator for discharging indoor air to the outside and supplying outside air to an indoor space, in which power consumption for controlling the temperature of air supplied to the indoor space may be reduced by a refrigerant flowing system.

It is another object of the present disclosure to provide an air conditioner having a ventilator provided with a plurality of separate heat exchangers, in which heat exchange efficiency may be maximized by driving a compressor.

It is yet another object of the present disclosure to provide an air conditioner which operates with optimal efficiency in response to outdoor temperature levels, by changing a configuration of the interior space of the ventilator.

The objects of the present disclosure are not limited to the aforementioned objects and other objects not described herein will be clearly understood by those skilled in the art from the following description.

In accordance with an aspect of the present disclosure, the above and other objects can be accomplished by providing an air conditioner, including: an outdoor unit having a compressor for compressing a refrigerant and an outdoor heat exchanger for heat exchange between the refrigerant and outside air; and a ventilator connected to the outdoor unit by a plurality of refrigerant pipes, and allowing the outside air to flow into an indoor space and indoor air to flow to an outside. Further, the ventilator may include: a case having a supply passage, through which the outside air flows into the indoor space, and a discharge passage through which the indoor air is discharged to the outside; a partition wall disposed in the case and separating the supply passage and the discharge passage; a main heat exchanger disposed in the supply passage and heat exchanging between flowing air and the refrigerant. In addition, the ventilator may include an outside air inlet damper opening and closing an outside air inlet formed at the case to allow the supply passage to communicate with an outside of the case; an indoor air outlet damper opening and closing an indoor air outlet formed at the case to allow the discharge passage to communicate with the outside of the case; a circulation hole damper opening and closing a circulation hole formed at the partition wall to allow the supply passage to communicate with the discharge passage; an outdoor temperature sensor for sensing temperature of the outside of the case; and a controller, which based on the temperature sensed by the outdoor temperature sensor, is configured to control operations of the outside air inlet damper, the indoor air outlet damper, and the circulation hole damper. Accordingly, in the case where outside air temperature is extremely low, the air conditioner may achieve low pressure in the outdoor unit by circulating the indoor air.

Specifically, in response to the temperature sensed by the outdoor temperature sensor being lower than a set temperature, the controller may operate the outside air inlet damper and the indoor air outlet damper to close the outside air inlet and the indoor air outlet, and may operate the circulation hole damper to open the circulation hole.

The air conditioner may further include a pressure sensor for sensing pressure of the refrigerant flowing into the outdoor unit, wherein based on the pressure of the refrigerant, which is sensed by the pressure sensor, the controller may control the operations of the outside air inlet damper, the indoor air outlet damper, and the circulation hole damper. Accordingly, the air conditioner may circulate the indoor air until low pressure is reached in the outdoor unit, so that the air supplied to the indoor space may be heat exchanged sufficiently by the main heat exchanger.

Specifically, in response to the pressure of the refrigerant, sensed by the pressure sensor, being higher than or equal to a set pressure, the controller may operate the outside air inlet damper and the indoor air outlet damper to close the outside air inlet and the indoor air outlet, and may operate the circulation hole damper to open the circulation hole.

In response to the pressure of the refrigerant, sensed by the pressure sensor, being higher than or equal to the set pressure for a predetermined period of time or more, the controller may operate the outside air inlet damper and the indoor air outlet damper to close the outside air inlet and the indoor air outlet, and may operate the circulation hole damper to open the circulation hole. In this manner, the air conditioner may not react sensitively to a temporary change in outdoor temperature.

The air conditioner may further include a discharge temperature sensor for sensing temperature of air discharged through the indoor air outlet, wherein based on the temperature sensed by the outdoor temperature sensor and the temperature sensed by the discharge temperature sensor, the controller may control the operations of the outside air inlet damper, the indoor air outlet damper, and the circulation hole damper.

Specifically, in response to the temperature sensed by the discharge temperature sensor being higher than the temperature sensed by the outdoor temperature sensor, the controller may operate the outside air inlet damper and the indoor air outlet damper to close the outside air inlet and the indoor air outlet, and may operate the circulation hole damper to open the circulation hole.

The air conditioner may further include: a recovery heat exchanger disposed in the discharge passage and heat exchanging between the flowing air and the refrigerant; and a refrigerant distributor connected to the plurality of refrigerant pipes, and supplying the refrigerant, introduced from the outdoor unit, to each of the main heat exchanger and the recovery heat exchanger or supplying the refrigerant, introduced from the main heat exchanger and the recovery heat exchanger, to the outdoor unit. Accordingly, the ventilator may heat exchange the air, supplied to the indoor space, by the main heat exchanger and may heat exchange the air, discharged to the outside, by the recovery heat exchanger.

The plurality of refrigerant pipes may include: a liquid refrigerant line connected to the outdoor heat exchanger disposed in the outdoor unit; a high-pressure refrigerant line through which the refrigerant, compressed by the compressor, flows; and a low-pressure refrigerant line through which the refrigerant flows to the compressor, such that the main heat exchanger and the recovery heat exchanger may be used as a condenser and an evaporator at the same time.

When the refrigerant, flowing through the liquid refrigerant line, flows from the outdoor heat exchanger to the refrigerant distributor, the circulation hole damper may close the circulation hole, such that the circulation hole may be closed during the cooling operation.

The air conditioner may further include a reheat exchanger disposed in the supply passage and connected to the refrigerant distributor, and heating the air flowing in the supply passage, thereby further heating the air supplied to the indoor space.

The air conditioner may further include a total heat exchanger disposed over the supply passage and the discharge passage and heat exchanging between indoor air and outdoor air by rotating. In response to the temperature sensed by the outdoor temperature sensor being lower than the set temperature, the controller may stop operation of the total heat exchanger, thereby minimizing pressure loss caused by the total heat exchanger.

In accordance with another aspect of the present disclosure, the above and other objects can be accomplished by providing a control method of an air conditioner having a supply passage allowing outside air to pass through a main heat exchanger to be supplied to an indoor space, a ventilator allowing indoor air to pass through a recovery heat exchanger to be discharged to an outside space, and an outdoor unit having a compressor, the control method including: operating the compressor and supplying a refrigerant, discharged to the compressor, to the main heat exchanger to start heating; sensing, by an outdoor temperature sensor, outside air temperature of the ventilator; sensing, by a pressure sensor, pressure of the refrigerant flowing to the compressor; and in response to the outside air temperature sensed by the outdoor temperature sensor being lower than a set temperature, and the pressure of the refrigerant sensed by the pressure sensor being higher than or equal to a set pressure, operating in a circulation mode in which, an outside air inlet and an indoor air outlet are closed, the outside air inlet formed at the ventilator to introduce the outside air, and the indoor air outlet formed at the ventilator to discharge the indoor air, and a circulation hole for communication between the supply passage and the discharge passage is opened, such that the indoor air circulates in the indoor space by passing through the ventilator. Accordingly, in an environment where the air supplied to the indoor space may not be heated sufficiently, the air conditioner may supply air at a proper temperature to the indoor space by circulating the indoor air.

The circulation mode may be performed in response to a period of time, during which the pressure sensed by the pressure sensor reaches a pressure higher than or equal to the set pressure, exceeding a predetermined period of time.

The control method of the air conditioner may further include sensing, by a discharge temperature sensor, temperature of air discharged to an outside environment from the ventilator, wherein the circulation mode is performed in response to the air temperature sensed by the discharge temperature sensor being higher than the air temperature sensed by the outdoor temperature sensor.

The circulation mode may include stopping operation of a total heat exchanger configured to heat exchange between air flowing in the supply passage and air flowing in the discharge passage by rotating.

The control method of the air conditioner may further include: in the circulation mode, sensing, by the pressure sensor, the pressure of the refrigerant flowing to the compressor; and in a ventilation mode, in response to the pressure of the refrigerant, sensed by the pressure sensor, being lower than the set pressure, closing the circulation hole and opening the outside air inlet and the indoor air outlet.

Other detailed matters of the exemplary embodiments are included in the detailed description and the drawings.

Effects

The air conditioner according to the present disclosure has one or more of the following effects.

Firstly, temperature of air introduced into an indoor space may be controlled by a compressor driving system without using an auxiliary heat source, such that separate power consumption may be reduced.

Secondly, a main heat exchanger in a supply passage and a recovery heat exchanger in a discharge passage, which are disposed in the ventilator, perform heat exchange in an opposite manner, such that efficiency of a refrigeration system may be increased.

Thirdly, in an environment where outside temperature is extremely low, such that air introduced from the outside may not be heated sufficiently before it is supplied to the indoor space, the air conditioner may ventilate the indoor and outdoor air after low pressure is reached in the outdoor unit by operating in a circulation mode. In this manner, the air conditioner may control the temperature of air supplied to the indoor space by air ventilation even in an ultra-low temperature environment.

The effects of the present disclosure are not limited to the aforesaid, and other effects not described herein will be clearly understood by those skilled in the art from the following description of the appended claims.

BRIEF DESCRIPTION OF THE DRAWINGS

FIGS. 8A and 8B are schematic diagrams illustrating an internal configuration of an outdoor unit according to an embodiment of the present disclosure, in which FIG. 8A illustrates a flow of a refrigerant during a cooling operation, and FIG. 8B illustrates a flow of a refrigerant during a heating operation.

DETAILED DESCRIPTION

Figure 1:
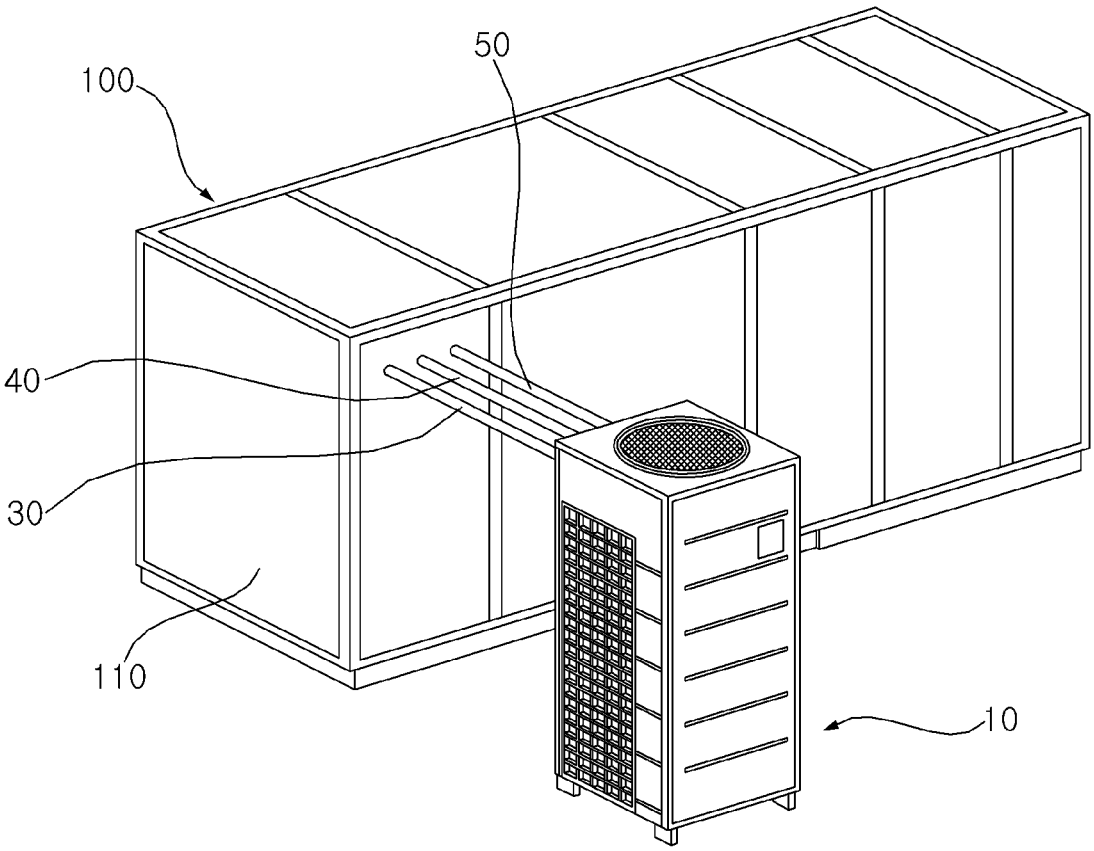
FIG. 1 is a schematic perspective view of an air conditioner including a ventilator, an outdoor unit, and a plurality of refrigerant pipes according to an embodiment of the present disclosure.
Figure 2:
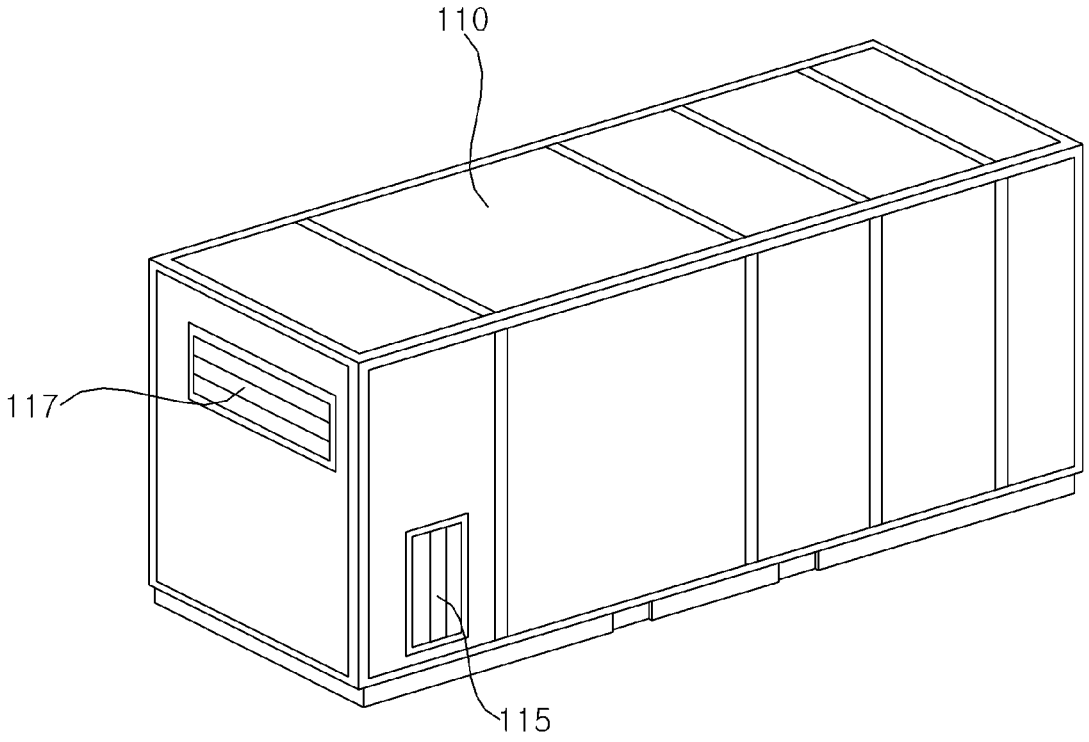
FIG. 2 is a perspective view of one side of a ventilator according to an embodiment of the present disclosure.
Figure 3:
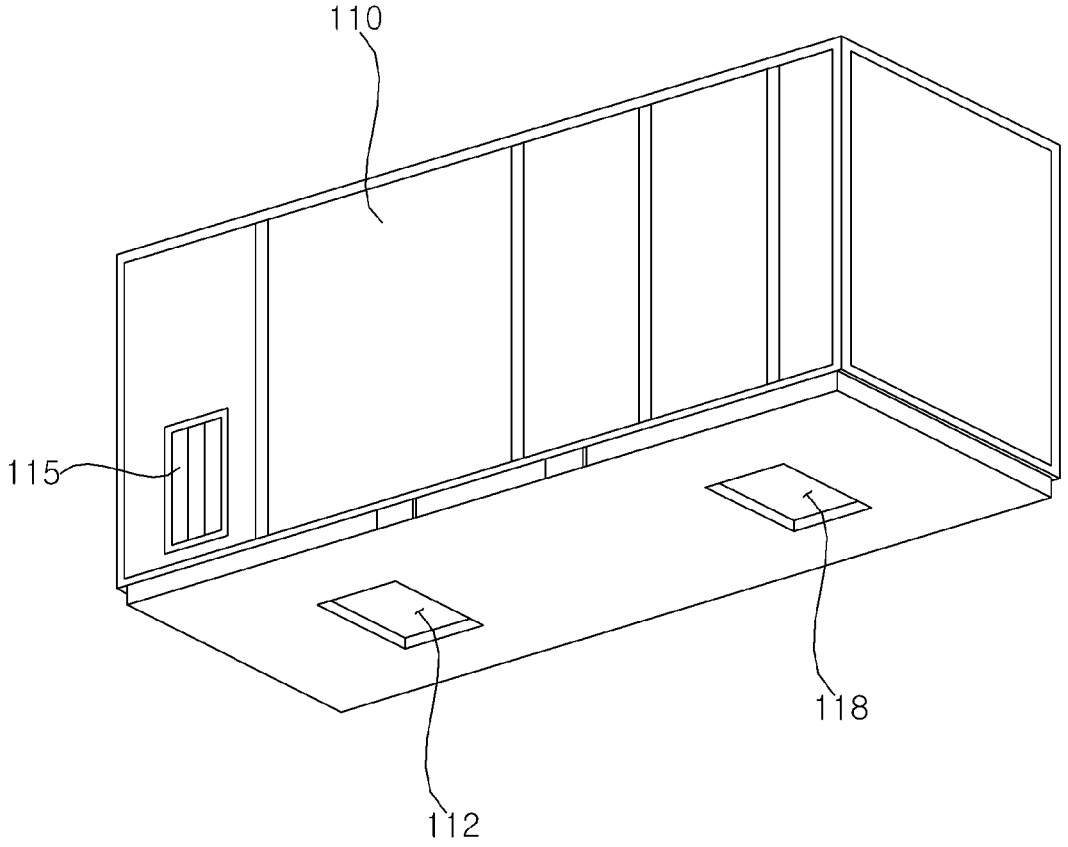
FIG. 3 is a perspective view of the other side of the ventilator according to an embodiment of the present disclosure.

Advantages and features of the present disclosure and methods for accomplishing the same will be more clearly understood from exemplary embodiments described below with reference to the accompanying drawings. However, the present disclosure is not limited to the following embodiments but may be implemented in various different forms. The embodiments are provided only to complete disclosure of the present disclosure and to fully provide a person having ordinary skill in the art to which the present disclosure pertains with the category of the present disclosure, and the present disclosure will be defined by the scope of the appended claims. Wherever possible, like reference numerals generally denote like elements through the specification.

Hereinafter, embodiments of an air conditioner of the present disclosure will be described with reference to the accompanying drawings.

Overall Configuration

An overall configuration of an air conditioner including a ventilator and an outdoor unit of the present disclosure will be described below with reference to FIG. 1.

The air conditioner according to the present disclosure includes: a compressor 12 for compressing a refrigerant; an outdoor unit 10 including an outdoor heat exchanger 14 for heat exchanging between a refrigerant and outside air; a ventilator 100 for discharging heat-exchanged indoor air to the outside, and supplying heat-exchanged outside air to an indoor space; and a plurality of refrigerant pipes 30, 40, and 50 connecting the ventilator 100 and the outdoor unit 10.

The ventilator 100 may discharge the indoor air to the outside environment and may supply the outside air to the indoor space. The ventilator 100 may include a plurality of heat exchangers to heat or cool the outside air supplied to the indoor space. The ventilator 100 serves to heat exchange between the outside air and the indoor air. The ventilator 100 heat exchanges the indoor air and discharges the heat-exchanged air to the outside environment.

The ventilator 100 includes a refrigerant distributor 150 for delivering the refrigerant to each of the plurality of heat exchangers. The ventilator 100 may supply a liquid refrigerant or a gaseous refrigerant to each of the plurality of heat exchangers through the refrigerant distributor 150. Accordingly, each of the plurality of heat exchangers included in the ventilator 100 may cool flowing air while heating, at the same time, the flowing air.

The ventilator 100 may be connected to the outdoor unit 10 by the plurality of refrigerant pipes 30, 40, and 50. The ventilator 100 may be connected to the outdoor unit 10 by three refrigerant pipes. The plurality of refrigerant pipes 30, 40, and 50 may include a liquid line 30, through which a liquid refrigerant flows, a high-pressure refrigerant line 40, through which a high-pressure gaseous refrigerant flows, and a low-pressure refrigerant line 50, through which a low-pressure gaseous refrigerant flows.

The outdoor unit 10 may compress the refrigerant by the compressor 12 provided therein and may supply the compressed refrigerant to the outdoor heat exchanger 14 or to the ventilator 100.

Ventilator

A ventilator according to an embodiment of the present disclosure will be described below with reference to FIGS. 2 to 7B.

The ventilator 100 of the present disclosure is disposed between an indoor space and an outdoor space, and allows the indoor air to flow to the outside and outside air to flow into the indoor space. The ventilator 100 of the present disclosure may serve to introduce the outside air into the indoor space and discharge the indoor air to the outside.

Figure 4:
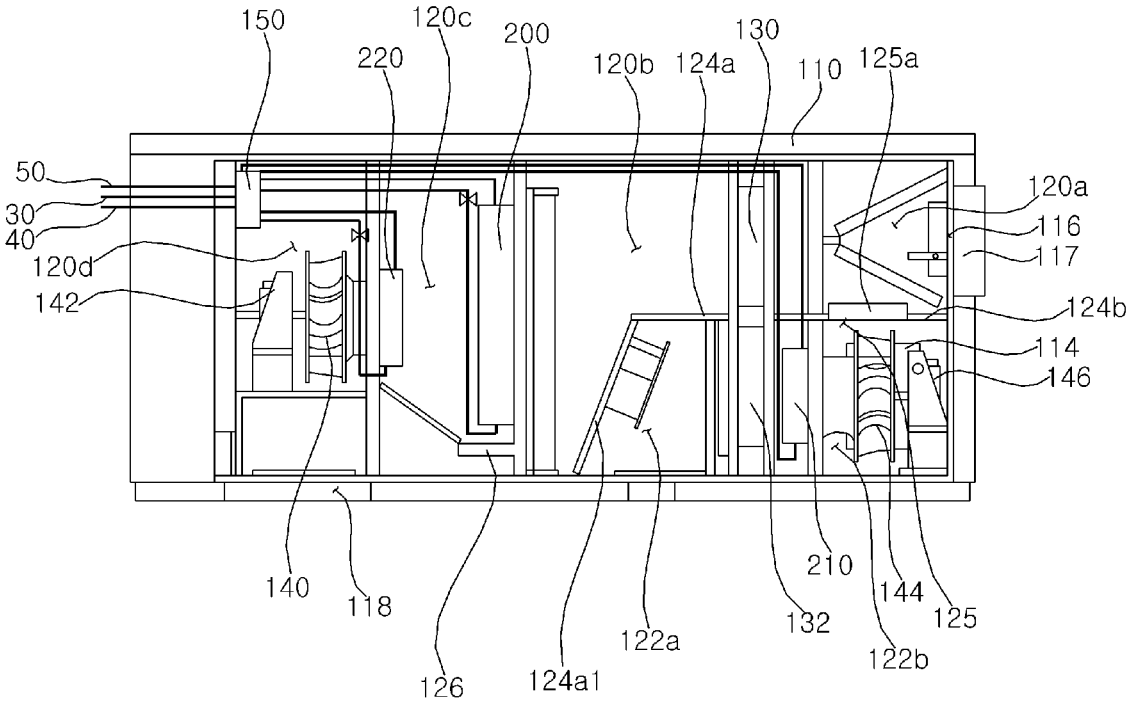
FIG. 4 is a schematic cross-sectional view of a ventilator according to an embodiment of the present disclosure.
Figure 5:
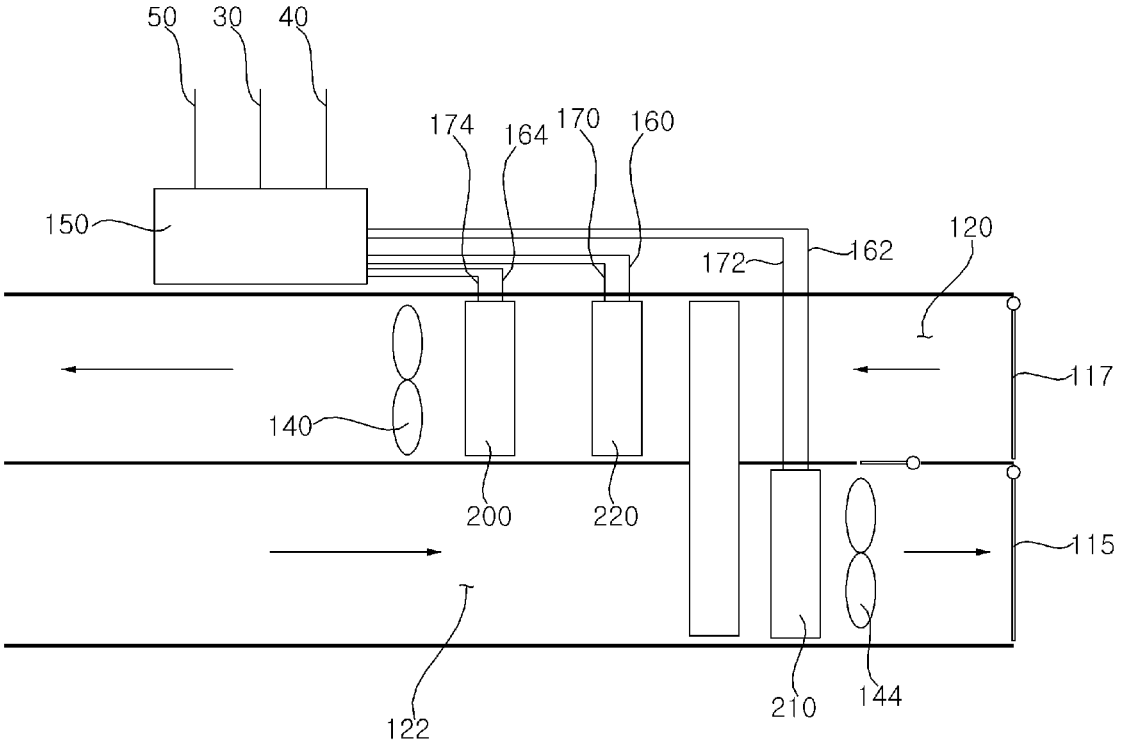
FIG. 5 is a diagram explaining air flowing through a ventilator according to an embodiment of the present disclosure.
Figure 6:
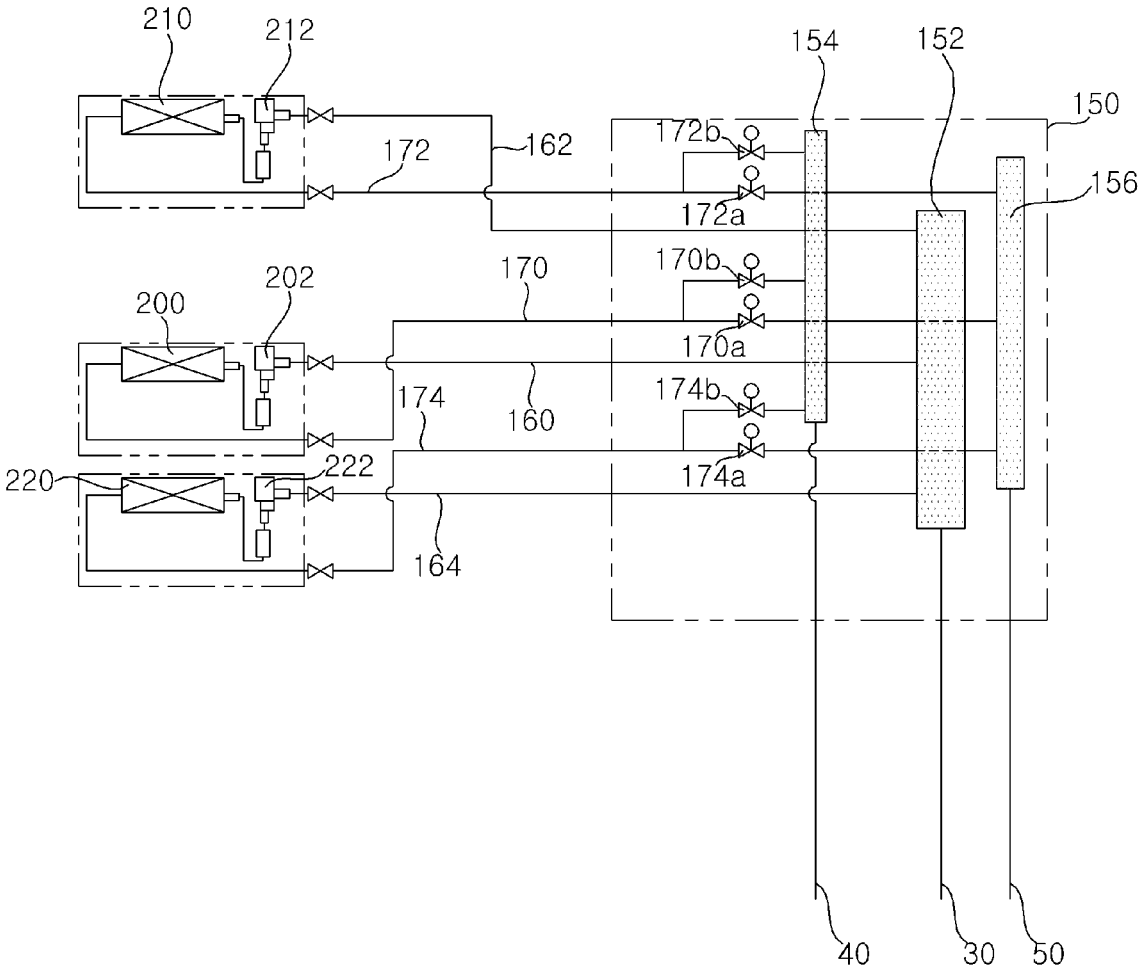
FIG. 6 is a system view illustrating a connection relationship between heat exchangers and a refrigerant distributor which are disposed in a ventilator according to an embodiment of the present disclosure.

The ventilator 100 may be connected to the outdoor unit 10 by the plurality of refrigerant pipes 30, 40, and 50. Referring to FIGS. 4 and 5, the ventilator 100 may be connected to the outdoor unit 10 by the liquid line 30, through which a liquid refrigerant flows, the high-pressure refrigerant line 40, through which a high-pressure gaseous refrigerant flows, and the low-pressure refrigerant line 50, through which a low-pressure gaseous refrigerant flows.

The ventilator 100 of the present disclosure includes: a case 110 having a supply passage 120, through which the outside air flows, and a discharge passage 122 through which the indoor air flows; a partition wall 124 disposed in the case 110 and separating the supply passage 120 and the discharge passage 122; a total heat exchanger 130 disposed on an inner surface of the case 110 and heat exchanging between the outside air, flowing through the supply passage 120, and the indoor air flowing through the discharge passage 122; a plurality of heat exchangers 200, 210, and 220 disposed in the supply passage 120 or the discharge passage 122 and heat exchanging between the flowing air and the refrigerant; and a refrigerant distributor 150 for supplying the refrigerant, flowing from the outdoor unit 10, to at least one of the plurality of heat exchangers 200, 210, and 220 and supplying the refrigerant, flowing from at least one of the plurality of heat exchangers 200, 210, and 220, to the outdoor unit 10.

The ventilator 100 may further include a first blower fan 140 rotatably disposed in the supply passage 120; a first blower motor 142 for rotating the first blower fan 140; a second blower fan 144 rotatably disposed in the discharge passage 122; and a second blower motor 146 for rotating the second blower fan 144. A cross flow fan, having an inlet region and an outlet region which are formed in a vertical direction, may be used as the first blower fan 140 and the second blower fan 144. The first blower fan 140 and the second blower fan 144 may have the inlet region formed in parallel with a rotation axis, and the outlet region formed in a radial direction perpendicular to the rotation axis.

The plurality of heat exchangers 200, 210, and 220 include: a main heat exchanger 200 disposed in the supply passage 120 and heat exchanging between the refrigerant and the flowing outside air; a recovery heat exchanger 210 disposed in the discharge passage 122 and heat exchanging between the refrigerant and the flowing indoor air; and a reheat exchanger 220 disposed in the supply passage 120 and heat exchanging between the refrigerant and the outside air having passed through the main heat exchanger 200.

The case 110 has the supply passage 120 and the discharge passage 122 formed therein. The case 110 forms a space in which the refrigerant distributor 150 is disposed. The space, in which the refrigerant distributor 150 is disposed, may be a space that separates the supply passage 120 and the discharge passage 122. Further, the refrigerant distributor 150 may be disposed on one side of the supply passage 120 or the discharge passage 122. The refrigerant distributor 150 may be disposed at a position not obstructing the flow of air.

The case 110 has an outside air inlet 116 which is formed on one side of the supply passage 120, and through which the inside of the case 110 communicates with the outside space; and an outside air supply port 118 which is formed on the other side of the supply passage 120, and through which the inside of the case 110 communicates with the indoor space. The case 110 has an indoor air outlet 114 which is formed on one side of the discharge passage 122, and through which the inside of the case 110 communicates with the outside space; and an indoor air inlet 112 which is formed on the other side of the discharge passage 122, and through which the inside of the case 110 communicates with the indoor space.

The case 110 may include an outside air inlet damper 117 for opening and closing the outside air inlet 116, and an indoor air outlet damper 115 for opening and closing the indoor air outlet 114. The outside air inlet damper 117 and the indoor air outlet damper 115 may operate in conjunction with a circulation hole damper 125*a* which will be described later.

The outside air inlet 116 and the outside air supply port 118 may be disposed in a vertical direction. The indoor air inlet 112 and the indoor air outlet 114 may be disposed in a vertical direction.

The supply passage 120 is shorter than the discharge passage 122. Referring to FIG. 4, the supply passage 120 may be a vertical passage having an inverted "L" shape.

The supply passage 120 may include: a first supply passage 120*a* formed between the outside air inlet 116 and the total heat exchanger 130; a second supply passage 120*b* formed between the total heat exchanger 130 and the main heat exchanger 200; a third supply passage 120*c* formed between the main heat exchanger 200 and the reheat exchanger 220; and a fourth supply passage 120*d* formed between the reheat exchanger 220 and the outside air supply port 118.

In the first supply passage 120*a*, a preheat exchanger (not shown) may be disposed which is connected to the refrigerant distributor 150 to heat the air flowing into the outside air inlet 116.

The second supply passage 120*b* has a flow cross-sectional area which increases from an upstream side toward a downstream side in an air flow direction. The main heat exchanger 200 is disposed at a downstream end portion of the second supply passage 120*b*. As the air, flowing through the second supply passage 120*b*, flows downstream, the flow velocity of the air decreases and the passage is expanded, such that a large amount of air may be heat exchanged by the main heat exchanger 200.

A drain pan 126 for temporarily storing condensate and discharging the condensate to the outside may be disposed at a lower side of the main heat exchanger 200.

The third supply passage 120*c* has a flow cross-sectional area which decreases from an upstream side toward a downstream side in an air flow direction. Accordingly, the condensate, generated in the air flowing through the third supply passage 120*c*, may flow to the drain pan 126. A flow velocity of the air flowing through the third supply passage 120*c* may be gradually increased.

The first blower fan 140 is disposed in the fourth supply passage 120*d*. The fourth supply passage 120*d* may be perpendicular to the third supply passage 120*c*. The first blower fan 140 allows the air, having passed through the reheat exchanger 220, to flow to the outside air supply port 118.

The discharge passage 122 may include a first discharge passage 122*a*, formed between the indoor air inlet 112 and the total heat exchanger 130, and a second discharge passage 122*b* formed between the total heat exchanger 130 and the indoor air outlet 114.

The second discharge passage 122*b* is disposed below the first supply passage 120*a*. The first discharge passage 122*a* is disposed below the second supply passage 120*b*.

The first discharge passage 122*a* is perpendicular to the second discharge passage 122*b*.

The recovery heat exchanger 210 is disposed in the second discharge passage 122*b*. The second blower fan 144 is disposed in the second discharge passage 122*b* to cause the air, flowing in the discharge passage 122, to flow to the indoor air outlet 114.

The partition wall 124 for separating the supply passage 120 and the discharge passage 122 is disposed in the case 110.

The partition wall 124 may include a first partition wall 124*a* separating the second supply passage 120*b* and the first discharge passage 122*a*, and a second partition wall 124*b* separating the first supply passage 120*a* and the second discharge passage 122*b*.

The second partition wall 124*b* may be formed as a horizontal plate for separating the first supply passage 120*a* and the second discharge passage 122*b*. The second partition wall 124*b* has a circulation hole 125 for communication between the supply passage 120 and the discharge passage 122. A circulation hole damper 125*a* for opening and closing the circulation hole 125 may be disposed at the second partition wall 124*b*. The circulation hole 125 is disposed above the second blower fan 144. Accordingly, the air blown by the second blower fan 144 may flow to the supply passage 120 through the circulation hole 125.

The first partition wall 124*a* may have an inclined surface 124*a*1 for expanding a flow cross-sectional area of the second supply passage 120*b*.

The total heat exchanger 130 is a device for recovering sensible heat and latent heat by using a temperature difference and a humidity difference between the outside air and return air while rotating a heat exchange body at a low speed. The total heat exchanger 130 may be formed as a cylindrical body, and has an internal structure which is formed as a honeycomb structure, thereby allowing the air to pass therethrough.

The total heat exchanger 130 may recover sensible heat and latent heat by using a temperature difference and a humidity difference between the outside air and return air while rotating a heat exchange body 132 at a low speed. The heat exchange body 132, made of aluminum as a base material, may recover sensible heat based on the heat transfer characteristics of aluminum. Further, aluminum is impregnated with a desiccant, such that the heat change body 132 may recover latent heat based on water vapor adsorption characteristics.

The total heat exchanger 130 may be disposed over both the supply passage 120 and the discharge passage 122. Each of the plurality of heat exchangers 200, 210, and 220 may be connected to the refrigerant distributor 150 by a plurality of indoor unit pipes 170, 172, and 174 and a plurality of indoor liquid lines 160, 162, and 164.

The main heat exchanger 200 may be disposed downstream of the total heat exchanger 130 in the supply passage 120. The main heat exchanger 200 may be disposed at a portion of the supply passage 120, in which a cross-sectional area is expanded. The main heat exchanger 200 may exchange heat with air in a larger area than the reheat exchanger 220. The main heat exchanger 200 may be connected to the refrigerant distributor 150 to receive a compressed refrigerant supplied from the high-pressure refrigerant line 40, or a liquid refrigerant supplied from the liquid line 30.

The recovery heat exchanger 210 may be disposed downstream of the total heat exchanger 130 in the discharge passage 122. The recovery heat exchanger 210 heats or cools the indoor air flowing to the outside space through the discharge passage 122. The recovery heat exchanger 210 may operate in an opposite manner to the main heat exchanger 200. Here, operation in the opposite manner may indicate that a heat exchange operation for heating or cooling the air may be performed in different manners. That is, when the main heat exchanger 200 cools the air flowing through the supply passage 120, the recovery heat exchanger 210 heats the air flowing through the discharge passage 122; and when the main heat exchanger 200 heats the air flowing through the supply passage 120, the recovery heat exchanger 210 cools the air flowing through the discharge passage 122.

The recovery heat exchanger 210 may be disposed upstream of the second blower fan 144 in the discharge passage 122.

The reheat exchanger 220 may be disposed downstream of the main heat exchanger 200 in the supply passage 120. The reheat exchanger 220 may be disposed at an inlet end of the first blower fan 140, such that the reheat exchanger 220 may heat the air flowing into the inlet end of the first blower fan 140. The reheat exchanger 220 may be connected to the refrigerant distributor 150, to receive the refrigerant discharged from the compressor 12. Further, in another example, the reheat exchanger 220 may be directly connected to the high-pressure refrigerant line 40, to receive the refrigerant discharged from the compressor 12.

The refrigerant distributor 150 may be connected to the outdoor unit 10 and each of the plurality of heat exchangers 200, 210, and 220. The refrigerant distributor 150 may be connected to the outdoor unit 10 by the liquid line 30, the high-pressure refrigerant line 40, and the low-pressure refrigerant line 50.

The refrigerant distributor 150 may be disposed on the inner surface of the case 110. The refrigerant distributor 150 may be connected to each of the plurality of heat exchangers 200, 210, and 220, which are disposed in the ventilator 100, by the plurality of indoor unit pipes 170, 172, and 174, and the plurality of indoor liquid lines 160, 162, and 164. The plurality of indoor unit pipes 170, 172, and 174 may include a first indoor unit pipe 170 connected to the main heat exchanger 200, a second indoor unit pipe 172 connected to the recovery heat exchanger 210, and a third indoor unit pipe 174 connected to the reheat exchanger 220.

Each of the plurality of indoor unit pipes 170, 172, and 174 may be branched from the inside of the refrigerant distributor 150, to be connected to a high-pressure refrigerant header 154 and a low-pressure refrigerant header 156. Flow control valves 170*a*, 170*b*, 172*a*, 172*b*, 174*a*, and 174*b* for controlling a flow of the refrigerant may be provided for each of the branched indoor unit pipes 170, 172, and 174.

The plurality of indoor liquid lines 160, 162, and 164 may include a first indoor liquid line 160 connected to the main heat exchanger 200, a second indoor liquid line 162 connected to the recovery heat exchanger 210, and a third indoor liquid line 164 connected to the reheat exchanger 220. Indoor heat exchanger expansion valves 202, 212, and 222 may be provided for each of the plurality of indoor liquid lines 160, 162, and 164. Accordingly, the indoor heat exchanger expansion valves 202, 212, and 222, disposed at each of the plurality of indoor liquid lines 160, 162, and 164, may expand the refrigerant flowing through each of the plurality of indoor liquid lines 160, 162, and 164.

The refrigerant distributor 150 may be connected to the main heat exchanger 200 by the first indoor liquid line 160 and the first indoor unit pipe 170. The refrigerant distributor 150 may be connected to the recovery heat exchanger 210 by the second indoor liquid line 162 and the second indoor unit pipe 172. The refrigerant distributor 150 may be connected to the reheat exchanger 220 by the third indoor liquid line 164 and the third indoor unit pipe 174.

The refrigerant distributor 150 may include a liquid refrigerant header 152 connecting the liquid line 30 with each of the plurality of heat exchangers 200, 210, and 220; the high-pressure refrigerant header 154 connecting the high-pressure refrigerant line 40 with each of the plurality of heat exchangers 200, 210, and 220; and the low-pressure refrigerant header 156 connecting the low-pressure refrigerant line 50 with each of the plurality of heat exchangers 200, 210, and 220.

The liquid refrigerant header 152 connects the liquid line 30 with each of the plurality of indoor liquid lines 160, 162, and 164. The high-pressure refrigerant header 154 connects the high-pressure refrigerant line 40 with each of the plurality of indoor unit pipes 170, 172, and 174. The low-pressure refrigerant header 156 connects the low-pressure refrigerant line 50 with each of the plurality of indoor unit pipes 170, 172, and 174.

<Outdoor Unit and Refrigerant Pipe>

A configuration of an outdoor unit of the present disclosure will be described below with reference to FIGS. 8A and 8B.

The outdoor unit 10 includes: a compressor 12 for compressing a refrigerant; an outdoor heat exchanger 14 disposed in the outdoor unit 10 and heat exchanging between a refrigerant and outside air; a first switching valve 18 for delivering the refrigerant, discharged from the compressor 12, to the ventilator 100 or delivering the refrigerant, supplied from the ventilator 100, to the compressor 12; and a second switching valve 20 for delivering the refrigerant, discharged from the compressor 12, to the outdoor heat exchanger 14 or delivering the refrigerant, introduced from the outdoor heat exchanger 14, to the compressor 12.

A compressor discharge pipe, allowing the refrigerant discharged from the compressor 12 to flow, may be branched to be connected to each of the first switching valve 18 and the second switching valve 20.

The first switching valve 18 may be connected to the compressor 12, the low-pressure refrigerant line 50, and the high-pressure refrigerant line 40. The second switching valve 20 may be connected to the compressor 12, the outdoor heat exchanger 14, and the low-pressure refrigerant line 50.

The outdoor unit 10 may further include an outdoor blower fan 16 disposed adjacent to the outdoor heat exchanger 14 and generating a flow of air around the outdoor heat exchanger 14. The outdoor heat exchanger 14 is connected to the liquid line 30, and delivers the liquid refrigerant, heat-exchanged by the outdoor heat exchanger 14, to the ventilator 100. The outdoor heat exchanger 14 may receive the heat-exchanged liquid refrigerant from the ventilator 100 through the liquid line 30. The outdoor unit 10 has an outdoor unit expansion valve 22 for expanding the refrigerant flowing in the liquid line 30.

The outdoor unit 10 may be connected to the ventilator 100 by the liquid line 30, the high-pressure refrigerant line 40, and the low-pressure refrigerant line 50. The liquid line 30 connects the outdoor heat exchanger 14 and the refrigerant distributor 150 of the ventilator 100. The high-pressure refrigerant line 40 connects the first switching valve 18 and the refrigerant distributor 150. The low-pressure refrigerant line 50 connects the second switching valve 20 or the compressor 12 and the refrigerant distributor 150.

Controller and Related Components

Figure 9:
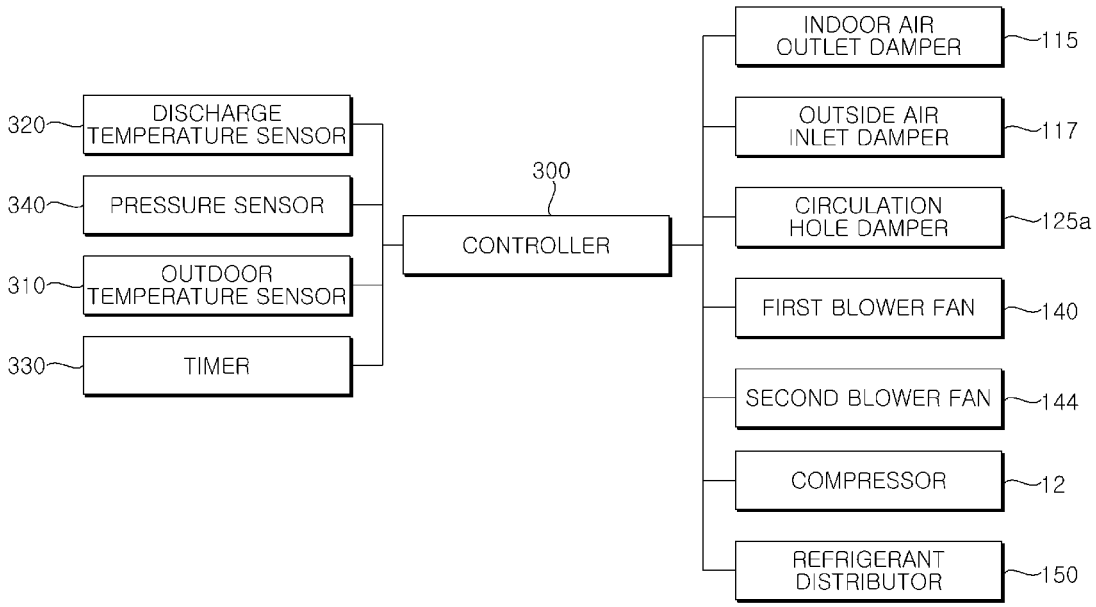
FIG. 9 is a block diagram illustrating a controller and related components according to an embodiment of the present disclosure.

A controller and related components of the present disclosure will be described below with reference to FIG. 9.

The air conditioner of the present disclosure includes a controller 300 for controlling opening and closing of the outside air inlet damper 117, the indoor air outlet damper 115, and the circulation hole damper 125*a*. The controller 300 may operate the air conditioner in a circulation mode for circulating the indoor air or a ventilation mode for discharging the indoor air to the outside and supplying the outside air to the indoor space.

The controller 300 may operate the air conditioner in a cooling mode for cooling the air flowing to the main heat exchanger 200 and a heating mode for heating the air flowing to the main heat exchanger 200. The controller 300 may operate the air conditioner in the cooling mode or the heating mode by operating the compressor 12 and controlling the first switching valve 18 and the second switching valve 20.

When operating the air conditioner in the circulation mode, the controller 300 closes the outside air inlet damper 117 and the indoor air outlet damper 115 and opens the circulation hole damper 125*a*. When operating the air conditioner in the ventilation mode, the controller 300 opens the outside air inlet damper 117 and the indoor air outlet damper 115 and closes the circulation hole damper 125*a*.

In the ventilation mode of the air conditioner, the controller 300 operates the first blower fan 140, the second blower fan 144, and the total heat exchanger 130. In the circulation model of the air conditioner, the controller 300 operates the first blower fan 140 and stops operation of the total heat exchanger 130.

The air conditioner of the present disclosure may include: an outdoor temperature sensor 310 for sensing the temperature of air introduced through the outside air inlet 116; a discharge temperature sensor 320 for sensing the temperature of air discharged through the indoor air outlet 114; a pressure sensor 340 for sensing the pressure of a refrigerant flowing from the outdoor heat exchanger 14 to the compressor 12; and a timer 330 for sensing an operating time of the compressor 12.

The controller 300 may operate the air conditioner in the ventilation mode or the circulation mode based on the temperature sensed by the outdoor temperature sensor 310. If the temperature sensed by the outdoor temperature sensor 310 is less than a set temperature, the controller 300 operates the air conditioner in the circulation model.

The controller 300 may operate the air conditioner in the circulation mode or the ventilation mode based on the temperature sensed by the outdoor temperature sensor 310 and the temperature sensed by the discharge temperature sensor 320. Under the condition of operation in the heating mode, if the air temperature sensed by the discharge temperature sensor 320 is higher than the air temperature sensed by the outdoor temperature sensor 310, the controller 300 may operate the air conditioner in the circulation mode.

The controller 300 may operate the air conditioner in the ventilation mode or the circulation mode based on the pressure of a refrigerant which is sensed by the pressure sensor 340. If the pressure in the outdoor unit, sensed by the pressure sensor 340, does not reach a predetermined low pressure, the controller 300 may operate the air conditioner in the circulation mode.

The controller 300 may operate the air conditioner in the ventilation mode or the circulation mode based on an operating time of the compressor 12 and a period of time measured by the timer 330. If the pressure in the outdoor unit, sensed by the pressure sensor 340, does not reach a predetermined low pressure, and the state is maintained for a period of time exceeding a predetermined period of time, the controller 300 may operate the air conditioner in the circulation mode.

Operation in Cooling Mode and Heating Mode

The cooling mode and heating mode of the air conditioner of the present disclosure will be described below with reference to FIGS. 7A to 8B.

The air conditioner of the present disclosure may operate in the cooling mode for a cooling operation and in the heating mode for a heating operation. The cooling operation and the heating operation may be determined based on the main heat exchanger 200 disposed in the ventilator 100. The first blower fan 140 and the second blower fan 144 operate during the cooling operation or the heating operation of the air conditioner. During the cooling operation or the heating operation of the air conditioner, the total heat exchanger 130 rotates to heat exchange between the air flowing through the supply passage 120 and the air flowing through the discharge passage 122.

Figure 8A:
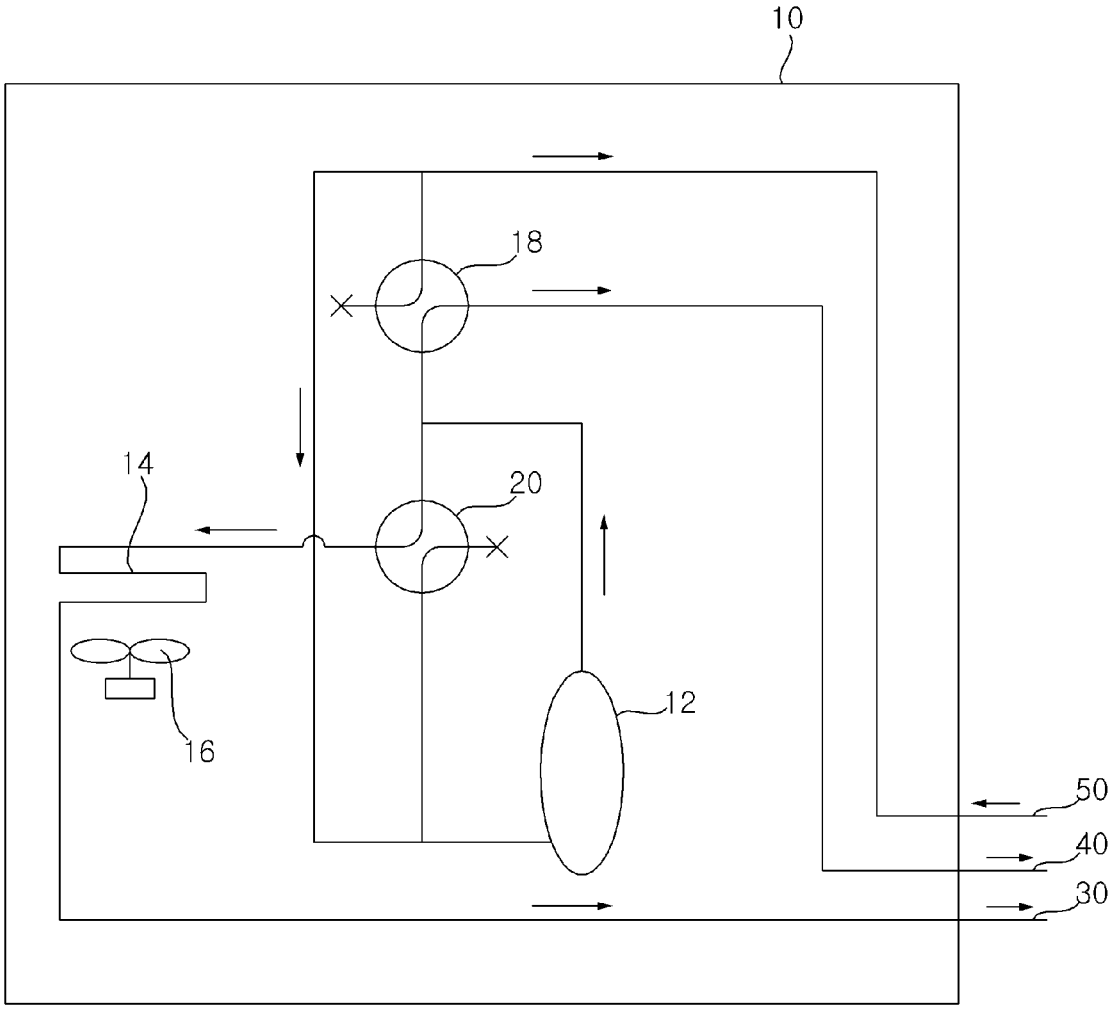

Referring to FIG. 8A, during the cooling operation of the air conditioner, the refrigerant discharged from the compressor 12 flows to the high-pressure refrigerant line 40 through the first switching valve 18. Further, the refrigerant discharged from the compressor 12 flows to the outdoor heat exchanger 14 through the second switching valve 20. The refrigerant, having passed through the outdoor heat exchanger 14, flows to the liquid line 30. In addition, the refrigerant, supplied from the ventilator 100 through the low-pressure refrigerant line 50, flows to the compressor 12.

Figure 8B:
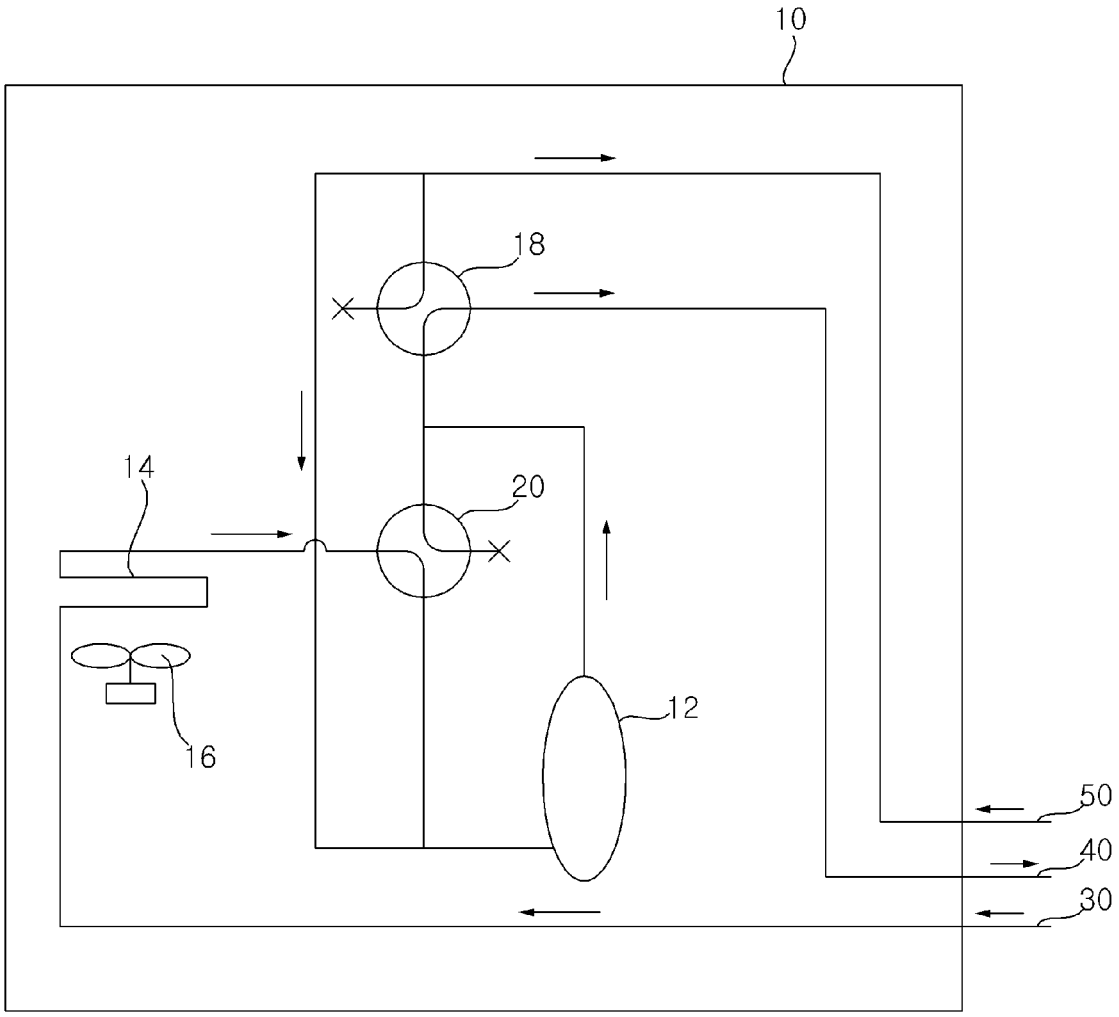

Referring to FIG. 8B, during the heating operation of the air conditioner, the refrigerant discharged from the compressor 12 flows to the high-pressure refrigerant line 40 through the first switching valve 18. The refrigerant, supplied from the ventilator 100 through the low-pressure refrigerant line 50, flows to the compressor 12. Further, the refrigerant, supplied from the ventilator 100 through the liquid line 30, flows to the outdoor heat exchanger 14, to be supplied to the compressor 12 through the second switching valve 20.

Figure 7A:
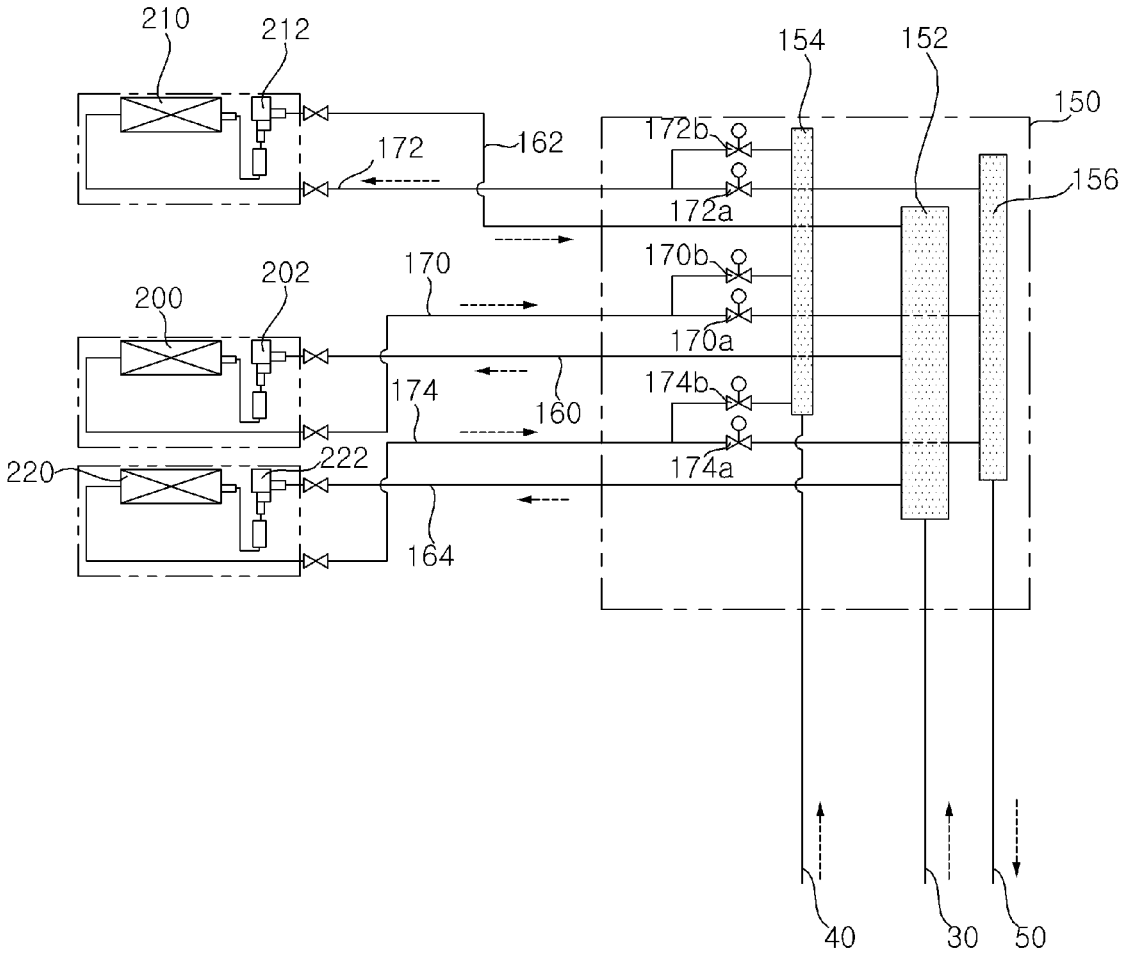
FIG. 7A is a diagram illustrating a flow of a refrigerant during a cooling operation in the system view of FIG. 6.

Referring to FIG. 7A, during the cooling operation of the air conditioner, the main heat exchanger 200 is connected to each of the liquid refrigerant header 152 and the low-pressure refrigerant header 156. During the cooling operation of the air conditioner, the recovery heat exchanger 210 is connected to each of the high-pressure refrigerant header 14 and the liquid refrigerant header 152. During the cooling operation of the air conditioner, the reheat exchanger 220 is connected to each of the high-pressure refrigerant header 14 and the liquid refrigerant header 152.

During the cooling operation of the air conditioner, the main heat exchanger 200 cools the air flowing in the discharge passage 122. During the cooling operation of the air conditioner, the recovery heat exchanger 210 heats the air flowing in the discharge passage 122. During the cooling operation of the air conditioner, the reheat exchanger 220 heats the air flowing in the supply passage 120.

During the cooling operation of the air conditioner, the air flowing in the supply passage 120 is heat exchanged with the indoor air by the total heat exchanger 130. During the cooling operation of the air conditioner, the air flowing in the supply passage 120 may be primarily cooled by heat exchange with cold air flowing in the discharge passage 122.

During the cooling operation of the air conditioner, the air flowing in the supply passage 120 after passing through the total heat exchanger 130 is cooled by passing through the main heat exchanger 200. In this case, condensate may be generated in the cooled air. During the cooling operation of the air conditioner, the air flowing through the main heat exchanger 200 may be dried by passing through the reheat exchanger 220. The reheat exchanger 220 is smaller in size than the main heat exchanger 200, and has a lower heat duty than the main heat exchanger 200, such that the air discharged from the outside air supply port 118 may be cooled and dried air. Accordingly, during the cooling operation of the air conditioner, the ventilator 100 may supply cooled and dried air to the indoor space.

During the cooling operation of the air conditioner, the air flowing in the discharge passage 122 may be heat exchanged with the outside air by the total heat exchanger 130. During the cooling operation of the air conditioner, the air flowing in the discharge passage 122 may be heated by passing through the recovery heat exchanger 210.

During the cooling operation of the air conditioner, the refrigerant discharged from the compressor 12 may be supplied to the high-pressure refrigerant line 40 through the first switching valve 18, and may be supplied to the outdoor heat exchanger 14 through the second switching valve 20.

Figure 7B:
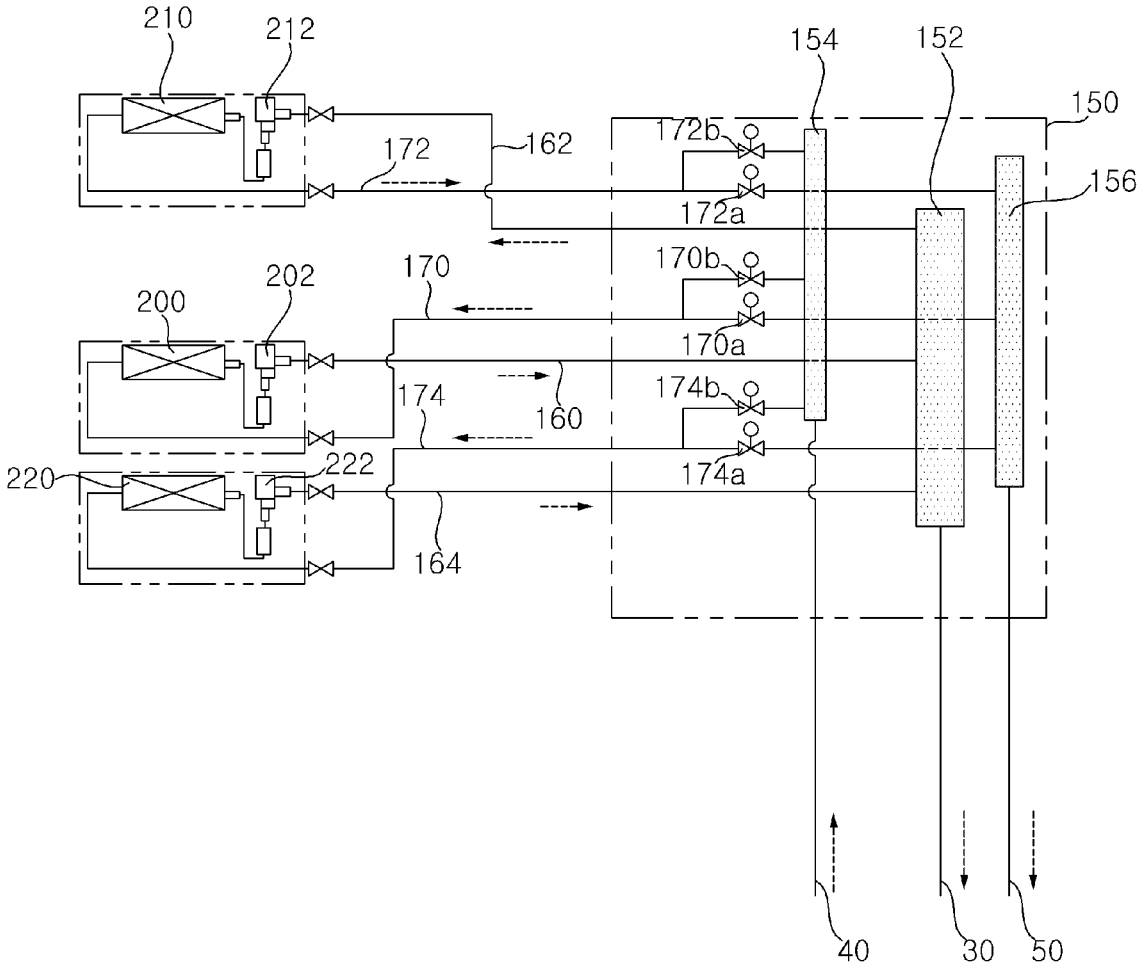
FIG. 7B is a diagram illustrating a flow of a refrigerant during a heating operation in the system view of FIG. 6.

Referring to FIG. 7B, during the heating operation of the air conditioner, the main heat exchanger 200 is connected to each of the high-pressure refrigerant header 154 and the liquid refrigerant header 152. During the heating operation of the air conditioner, the recovery heat exchanger 210 is connected to each of the liquid refrigerant header 152 and the low-pressure refrigerant header 156. During the heating operation of the air conditioner, the reheat exchanger 220 is connected to each of the high-pressure refrigerant header 154 and the liquid refrigerant header 152.

During the heating operation of the air conditioner, the main heat exchanger 200 heats the air flowing in the supply passage 120. During the heating operation of the air conditioner, the recovery heat exchanger 210 cools the air flowing in the discharge passage 122. During the heating operation of the air condition, the reheat exchanger 220 heats the air flowing in the supply passage 120.

During the heating operation of the air conditioner, the air flowing in the supply passage 120 is heat exchanged with the indoor air by the total heat exchanger 130. During the cooling operation of the air conditioner, the air flowing in the supply passage 120 may be primarily heated by heat exchange with warm air flowing in the discharge passage 122.

During the heating operation of the air conditioner, the air flowing in the supply passage 120 after passing through the total heat exchanger 130 is heated by passing through the main heat exchanger 200. During the heating operation of the air conditioner, the flowing air, having passed through the main heat exchanger 200, may be heated by passing through the reheat exchanger 220.

During the heating operation of the air conditioner, the air flowing in the discharge passage 122 is heat exchanged with the outside air by the total heat exchanger 130. During the heating operation of the air conditioner, the air flowing in the discharge passage 122 may be cooled by passing through the recovery heat exchanger 210.

During the heating operation of the air conditioner, the refrigerant discharged from the compressor 12 is supplied to the high-pressure refrigerant line 40 through the first switching valve 18.

Figure 10:
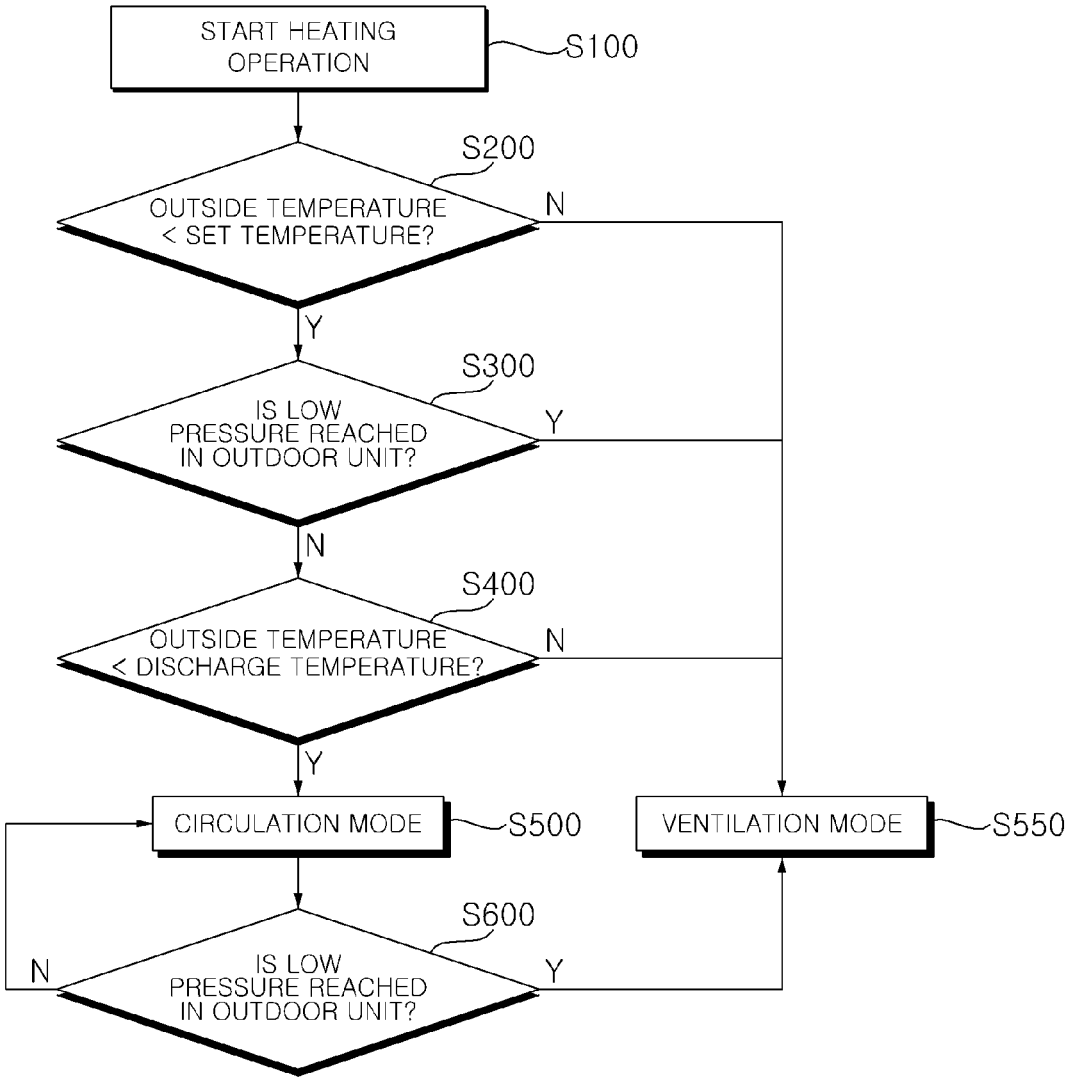
FIG. 10 is a flowchart illustrating a control method of an air conditioner according to an embodiment of the present disclosure.

Operation in Ventilation Mode and Circulation Mode During Operation of Air Conditioner in Heating Mode The operation of the air conditioner in the heating mode will be described below with reference to FIG. 10.

First, a heating operation is started (S100). When the heating operation of the air conditioner is started, the outdoor temperature sensor 310 senses the temperature of air flowing to the outside air inlet 116, and the controller 300 determines whether the temperature sensed by the outdoor temperature sensor 310 is lower than a set temperature (S200).

If the temperature sensed by the outdoor temperature sensor 310 is higher than or equal to the set temperature, the controller 300 may operate the air conditioner in the ventilation mode (S550). Here, the set temperature may be set to a level which is difficult to be adjusted, even by operation of the main heat exchanger 200 and the reheat exchanger 220, to a target temperature desired by a user for air supplied to the indoor space. For example, the temperature may be set to 15° C. below zero.

That is, the controller 300 closes the circulation hole damper 125*a* and opens the outside air inlet damper 117 and the indoor air outlet damper 115. The controller 300 operates the total heat exchanger 130 to heat exchange between the air flowing in the supply passage 120 and the air flowing in the discharge passage 122.

If the temperature sensed by the outdoor temperature sensor 310 is lower than the set temperature, the controller 300 determines whether a low pressure is reached in the outdoor unit (S300). The pressure sensor 340 senses the pressure of a refrigerant flowing into the compressor 12, and the controller 300 determines whether the pressure in the outdoor unit 10 reaches a pressure lower than a set pressure.

The timer 330 may sense a period of time during which the pressure of the outdoor unit 10, sensed by the pressure sensor 340, is adjusted to a pressure lower than the set pressure. If a period of time during which the temperature sensed by the outdoor temperature sensor 310 is adjusted to a temperature lower than the set temperature exceeds a predetermined period of time, the controller 300 may operate the air conditioner in the ventilation mode (S500).

That is, the controller 300 opens the circulation hole damper 125*a* and closes the outside air inlet damper 117 and the indoor air outlet damper 115. By stopping operation of the total heat exchanger 130 to cause the air, introduced through the indoor air inlet 112, to flow to the outside air supply port 118, the controller 300 may circulate the indoor air.

Then, the controller 300 determines whether a low pressure is reached in the outdoor unit 10 (S600) for the air conditioner operating in the circulation mode, and when a low pressure is reached in the outdoor unit 10, the controller 300 operates the air conditioner in the ventilation mode.

In addition, the controller 300 determines a difference between the temperature, sensed by the outdoor temperature sensor 310, of the outside air introduced into the ventilator 100 and the temperature, sensed by the discharge temperature sensor 320, of the indoor air discharged from the ventilator 100 (S400), and operates the air conditioner in the circulation mode (S550) or the ventilation mode (S500).

That is, upon sensing the temperature of air discharged through the indoor air outlet 114 by using the discharge temperature sensor 320, if the temperature, sensed by the discharge temperature sensor 320, of the indoor air discharged from the ventilator 100 is higher than the temperature of the outside air introduced into the ventilator 100, the controller 300 may operate the air conditioner in the circulation mode to achieve low pressure in the outdoor unit 10.

Although the preferred embodiments of the present disclosure have been disclosed with reference to the illustrated drawings, those skilled in the art will appreciate that the present disclosure is not limited to those exemplary embodiments and various modifications, additions and substitutions are possible, without departing from the scope and spirit of the invention as disclosed in the accompanying claims. Such modifications should not be individually understood from the technical spirit or prospect of the present disclosure.

What is claimed is:

1. An air conditioner, comprising:

an outdoor unit including a compressor configured to compress a refrigerant and an outdoor heat exchanger configured to exchange heat between the refrigerant and outside air; and a ventilator connected to the outdoor unit by a plurality of refrigerant pipes, and configured to supply the outside air to an indoor space and discharge the indoor air to an outside, wherein the ventilator comprises:

a case defining a supply passage through which the outside air is supplied to the indoor space, and a discharge passage through which the indoor air is discharged to the outside;

a partition wall disposed in the case and separating the supply passage and the discharge passage;

a main heat exchanger disposed in the supply passage and configured to exchange heat between air flowing through the supply passage and the refrigerant;

an outside air inlet damper configured to open and close an outside air inlet formed in the case and configured to allow the supply passage to communicate with the outside;

an indoor air outlet damper configured to open and close an indoor air outlet formed in the case and configured to allow the discharge passage to communicate with the outside;

a circulation hole damper configured to open and close a circulation hole formed in the partition wall and configured to allow the supply passage to communicate with the discharge passage;

an outdoor temperature sensor configured to sense a temperature of the outside;

a controller configured to control operations of the outside air inlet damper, the indoor air outlet damper, and the circulation hole damper based on the temperature sensed by the outdoor temperature sensor, and a pressure sensor configured to sense pressure of the refrigerant flowing into the outdoor unit, wherein the controller is configured to control the operations of the outside air inlet damper, the indoor air outlet damper, and the circulation hole damper based on the pressure of the refrigerant sensed by the pressure sensor.

2. The air conditioner of claim 1, wherein the controller is configured to operate the outside air inlet damper and the indoor air outlet damper to close the outside air inlet and the indoor air outlet, respectively, and operate the circulation hole damper to open the circulation hole when the temperature sensed by the outdoor temperature sensor is lower than a set temperature.

3. The air conditioner of claim 1, wherein the controller is configured to operate the outside air inlet damper and the indoor air outlet damper to close the outside air inlet and the indoor air outlet, respectively, and operate the circulation hole damper to open the circulation hole when the pressure of the refrigerant sensed by the pressure sensor is higher than or equal to a set pressure.

4. The air conditioner of claim 1, wherein the controller is configured to operate the outside air inlet damper and the indoor air outlet damper to close the outside air inlet and the indoor air outlet, respectively, and operate the circulation hole damper to open the circulation hole when the pressure of the refrigerant sensed by the pressure sensor is higher than or equal to a set pressure for a predetermined period of time or more.

5. The air conditioner of claim 1, further comprising a discharge temperature sensor configured to sense a temperature of air discharged through the indoor air outlet, wherein the controller is configured to control the operations of the outside air inlet damper, the indoor air outlet damper, and the circulation hole damper based on the temperature sensed by the outdoor temperature sensor and the temperature sensed by the discharge temperature sensor.

6. The air conditioner of claim 5, wherein the controller is configured to operate the outside air inlet damper and the indoor air outlet damper to close the outside air inlet and the indoor air outlet, respectively, and operate the circulation hole damper to open the circulation hole when the temperature sensed by the discharge temperature sensor is higher than the temperature sensed by the outdoor temperature sensor.

7. The air conditioner of claim 1, further comprising a total heat exchanger disposed over the supply passage and the discharge passage and configured to exchange heat between indoor air and outdoor air by rotation of the total heat exchanger.

8. The air conditioner of claim 7, wherein the controller is configured to stop operation of the total heat exchanger when the temperature sensed by the outdoor temperature sensor is lower than a set temperature.

9. An air conditioner, comprising:

an outdoor unit including a compressor configured to compress a refrigerant and an outdoor heat exchanger configured to exchange heat between the refrigerant and outside air; and a ventilator connected to the outdoor unit by a plurality of refrigerant pipes, and configured to supply the outside air to an indoor space and discharge the indoor air to an outside, wherein the ventilator comprises:

a case defining a supply passage through which the outside air is supplied to the indoor space, and a discharge passage through which the indoor air is discharged to the outside;

a partition wall disposed in the case and separating the supply passage and the discharge passage;

a main heat exchanger disposed in the supply passage and configured to exchange heat between air flowing through the supply passage and the refrigerant, an outside air inlet damper configured to open and close an outside air inlet formed in the case and configured to allow the supply passage to communicate with the outside;

an indoor air outlet damper configured to open and close an indoor air outlet formed in the case and configured to allow the discharge passage to communicate with the outside:

a circulation hole damper configured to open and close a circulation hole formed in the partition wall and configured to allow the supply passage to communicate with the discharge passage;

an outdoor temperature sensor configured to sense a temperature of the outside;

a controller configured to control operations of the outside air inlet damper, the indoor air outlet damper, and the circulation hole damper based on the temperature sensed by the outdoor temperature sensor;

a recovery heat exchanger disposed in the discharge passage and configured to exchange heat between the air flowing through the discharge passage and the refrigerant; and a refrigerant distributor connected to the plurality of refrigerant pipes, the refrigerant distributor being configured to supply the refrigerant from the outdoor unit to each of the main heat exchanger and the recovery heat exchanger and discharge the refrigerant from the main heat exchanger and the recovery heat exchanger to the outdoor unit.

10. The air conditioner of claim 9, wherein the plurality of refrigerant pipes comprise:

a liquid refrigerant line connected to the outdoor heat exchanger disposed in the outdoor unit;

a high-pressure refrigerant line connected to an outlet of the compressor; and a low-pressure refrigerant line connected to an inlet of the compressor.

11. The air conditioner of claim 10, wherein the circulation hole damper is configured to close the circulation hole when the refrigerant flows through the liquid refrigerant line from the outdoor heat exchanger to the refrigerant distributor.

12. The air conditioner of claim 9, further comprising a reheat exchanger disposed in the supply passage, connected to the refrigerant distributor, and configured to heat the air flowing in the supply passage.

13. A method for controlling an air conditioner, wherein the air conditioner includes a supply passage configured to allow outside air to pass through a main heat exchanger to be supplied to an indoor space, a ventilator configured to allow indoor air to pass through a discharge passage and a recovery heat exchanger to be discharged to an outside space, and an outdoor unit having a compressor, the method comprising:

operating the compressor to compress a refrigerant and discharge the compressed refrigerant from the compressor to the main heat exchanger;

sensing an outside air temperature using an outdoor temperature sensor;

sensing a pressure of refrigerant flowing to the compressor using a pressure sensor; and operating the air conditioner in a circulation mode, comprising:

closing an outside air inlet and an indoor air outlet, the outside air inlet being formed in the ventilator to introduce the outside air, and the indoor air outlet being formed in the ventilator to discharge the indoor air, and opening a circulation hole configured to provide fluid communication between the supply passage and the discharge passage such that the indoor air circulates in the indoor space by passing through the ventilator when the temperature of the air sensed by the outdoor temperature sensor is lower than a set temperature, and the pressure of the refrigerant sensed by the pressure sensor is higher than or equal to a set pressure.

14. The method of claim 13, wherein the air conditioner is operated in the circulation mode when the pressure sensed by the pressure sensor reaches a pressure higher than or equal to the set pressure for at least a predetermined period of time.

15. The method of claim 13, further comprising sensing, by a discharge temperature sensor, temperature of the air discharged to the outside space from the ventilator, wherein the circulation mode is performed when the air temperature sensed by the discharge temperature sensor is higher than the air temperature sensed by the outdoor temperature sensor.

16. The method of claim 13, wherein the circulation mode comprises stopping operation of a total heat exchanger, wherein the total heat exchanger is configured to exchange heat between air flowing in the supply passage and air flowing in the discharge passage by rotation of the total heat exchanger.

17. The method of claim 13, further comprising:

sensing the pressure of the refrigerant flowing to the compressor using the pressure sensor during the circulation mode; and closing the circulation hole and opening the outside air inlet and the indoor air outlet when the pressure of the refrigerant sensed by the pressure sensor is lower than the set pressure.

* * * * *